US010889474B2

(12) United States Patent
Hall et al.

(10) Patent No.: US 10,889,474 B2
(45) Date of Patent: Jan. 12, 2021

(54) BATTERY CELL SHIFTING IN ROTATIONAL MOTOR APPLICATIONS

(71) Applicants: David R. Hall, Provo, UT (US); Daniel Madsen, Vineyard, UT (US); Jerome Miles, Spanish Fork, UT (US); Christopher Jones, Spanish Fork, UT (US); Nathan Davis, Bountiful, UT (US)

(72) Inventors: David R. Hall, Provo, UT (US); Daniel Madsen, Vineyard, UT (US); Jerome Miles, Spanish Fork, UT (US); Christopher Jones, Spanish Fork, UT (US); Nathan Davis, Bountiful, UT (US)

(73) Assignee: Hall Labs LLC, Provo, UT (US)

( * ) Notice: Subject to any disclaimer, the term of this patent is extended or adjusted under 35 U.S.C. 154(b) by 400 days.

(21) Appl. No.: 15/836,267

(22) Filed: Dec. 8, 2017

(65) Prior Publication Data

US 2019/0177135 A1 Jun. 13, 2019

(51) Int. Cl.

| | |
|---|---|
| ***B66D 1/12*** | (2006.01) |
| ***B66D 1/46*** | (2006.01) |
| ***B66D 1/22*** | (2006.01) |

(52) U.S. Cl.

CPC ..... *B66D 1/12* (2013.01); *B66D 1/22* (2013.01); *B66D 1/46* (2013.01); *B66D 2700/0141* (2013.01)

(58) Field of Classification Search

CPC . B66D 1/12; B66D 1/22; B66D 1/225; B66D 1/46; B66D 2700/0141

See application file for complete search history.

(56) References Cited

U.S. PATENT DOCUMENTS

| | | | | | |
|---|---|---|---|---|---|
| 3,396,323 | A * | 8/1968 | Auld | H02P 7/2885 | 388/823 |
| 3,504,229 | A * | 3/1970 | Gerry | H02K 21/04 | 315/209 M |
| 3,566,717 | A * | 3/1971 | Berman et al. | B60K 6/365 | 477/3 |
| 3,603,678 | A * | 9/1971 | Anderl | G03B 19/18 | 352/169 |
| 3,912,093 | A * | 10/1975 | Kruschke | B60P 1/5428 | 414/542 |
| 4,884,784 | A * | 12/1989 | Nix | B66D 1/12 | 254/362 |
| 5,522,582 | A * | 6/1996 | Dilks | B66D 1/40 | 254/323 |
| 5,663,541 | A * | 9/1997 | McGregor, II | B66D 1/46 | 200/17 R |
| 5,738,177 | A * | 4/1998 | Schell | B25B 23/14 | 173/178 |
| 6,250,607 | B1 * | 6/2001 | Strom | B66D 1/12 | 254/342 |

(Continued)

*Primary Examiner* — Emmanuel M Marcelo

(57) ABSTRACT

Devices, systems, and methods for varying rotational speeds is disclosed. A battery pack has a plurality of batteries and a switch. The battery pack has an overall voltage. The switch varies the overall voltage in discrete steps by combining the plurality of batteries in series, in parallel, or in a combination thereof. A motor drives a shaft at a rotational speed. The motor is powered by the battery pack. The rotational speed varies proportionally with the overall voltage.

20 Claims, 6 Drawing Sheets

(56) References Cited

U.S. PATENT DOCUMENTS

| | | | | |
|---|---|---|---|---|
| 6,367,778 | B1 * | 4/2002 | Mobley | B65H 51/10 254/134.3 R |
| 7,543,798 | B2 * | 6/2009 | Cunningham | B66D 3/20 191/12.2 R |
| 8,006,958 | B2 * | 8/2011 | Starks | B66D 3/20 254/323 |
| 2002/0175656 | A1 * | 11/2002 | Matsunaga | H02J 7/0031 320/128 |
| 2007/0144310 | A1 * | 6/2007 | Pozgay | B25F 5/02 81/57.26 |
| 2008/0061276 | A1 * | 3/2008 | Averill | B66D 1/22 254/323 |
| 2008/0078979 | A1 * | 4/2008 | Geagan | B66D 1/04 254/267 |
| 2012/0285756 | A1 * | 11/2012 | Treadway | A63C 17/12 180/65.51 |
| 2013/0271054 | A1 * | 10/2013 | Watanabe | B25B 21/00 318/490 |
| 2014/0091648 | A1 * | 4/2014 | Kumagai | B25F 5/02 310/50 |
| 2014/0252286 | A1 * | 9/2014 | Averill | B66D 1/16 254/344 |
| 2015/0226001 | A1 * | 8/2015 | Adams | H04W 52/0277 160/84.02 |
| 2017/0043983 | A1 * | 2/2017 | Hiekata | B66C 13/12 |
| 2018/0090953 | A1 * | 3/2018 | Hall | H02J 50/40 |
| 2018/0229976 | A1 * | 8/2018 | Kawai | B66C 23/62 |
| 2018/0250020 | A1 * | 9/2018 | Carusillo | A61B 17/1622 |
| 2018/0297179 | A1 * | 10/2018 | Osada | B25B 21/02 |
| 2018/0319635 | A1 * | 11/2018 | Hiekata | B66C 23/36 |

* cited by examiner

BATTERY CELL SHIFTING IN ROTATIONAL MOTOR APPLICATIONS

FIELD OF THE INVENTION

The devices, systems, and methods described herein relate generally to rotation of objects. More particularly, the devices, systems, and methods described herein relate to winching.

BACKGROUND

In operating a winch, fast extension and fast retraction of rope from the drum is desirable. Gearboxes are utilized to this end, with low gears, designed for pulling heavy loads, resulting in slow line speeds, and high gears, designed for low to no load, resulting in high line speeds. To achieve faster line speeds, further gearboxes could be added, but this solution increases the size of the winch. Devices, systems, and methods for achieving faster line speeds without increasing the size of the winch would be beneficial.

SUMMARY

Devices, systems, and methods for varying rotational speeds are disclosed. A battery pack has a plurality of batteries and a switch. The battery pack has an overall voltage. The switch varies the overall voltage in discrete steps by combining the plurality of batteries in series, in parallel, or in a combination thereof. A motor drives a shaft at a rotational speed. The motor is powered by the battery pack. The rotational speed varies proportionally with the overall voltage.

The shaft may drive rotation of planetary gearsets. The planetary gearsets may drive rotation of a drum. The drum may be a spool for a winching line. The drum may rotate at a first rotational speed while the winching line is under a load due to a first overall voltage. The drum may rotate at a second rotational speed while the winching line is under substantially no load due to a second overall voltage. The second rotational speed may be greater than the first rotational speed.

A controller may control the switch. The battery pack may include a voltmeter, an amp meter, or a combination thereof. These may send signals to the controller regarding the voltage and current of the battery pack.

The switch may be a bipolar transistor, a power diode, a MOSFET, an IGBT, an SCR, a TRIAC, a GTO, a relay, or a combination thereof. The plurality of batteries may be rechargeable batteries.

BRIEF DESCRIPTION OF THE DRAWINGS

In order that the advantages of the described devices, systems, and methods will be readily understood, a more particular description of the described devices, systems, and methods briefly described above will be rendered by reference to specific embodiments illustrated in the appended drawings. Understanding that these drawings depict only typical embodiments of the described devices, systems, and methods and are not therefore to be considered limiting of its scope, the devices, systems, and methods will be described and explained with additional specificity and detail through use of the accompanying drawings, in which.

DETAILED DESCRIPTION

It will be readily understood that the components of the described devices, systems, and methods, as generally described and illustrated in the Figures herein, could be arranged and designed in a wide variety of different configurations. Thus, the following more detailed description of the embodiments of the described devices, systems, and methods, as represented in the Figures, is not intended to limit the scope of the described devices, systems, and methods, as claimed, but is merely representative of certain examples of presently contemplated embodiments in accordance with the described devices, systems, and methods.

In operating a winch, fast extension and fast retraction of rope from the drum is desirable. Gearboxes are utilized to this end, with low gears, designed for pulling heavy loads, resulting in slow line speeds, and high gears, designed for low to no load, resulting in high line speeds. To achieve faster line speeds, further gearboxes could be added, but this solution increases the size of the winch. The devices, systems, and methods disclosed herein provide faster line speeds without increasing the size of the winch. The power supply for the motor in the winch is a battery pack. By combining the batteries in series, a higher voltage is obtained than combining the batteries in parallel, or a combination of parallel and series. In the series configuration, the overall voltage is higher and the motor runs faster than in parallel or any combination of parallel and series. So, for fast line speeds, the batteries can be switched to series and run faster, while for heavy loads, the batteries can be used in parallel. The switching can be done electronically, meaning the added equipment to the winch to make this possible is negligible. Therefore, the winch is able to run faster without increasing size.

The term winching line is understood herein to refer to any rope, line, cable, or similar that may be used in a winch or other rotating devices. While winches are used as the primary example in this application, it should be understood that other motor operated systems can benefit from the devices, systems, and methods disclosed herein. Any motor driving a shaft run by batteries can utilize this switching to obtain discrete steps in voltage, leading to faster or slower rotational speeds with negligible equipment needs.

Figure 1A:
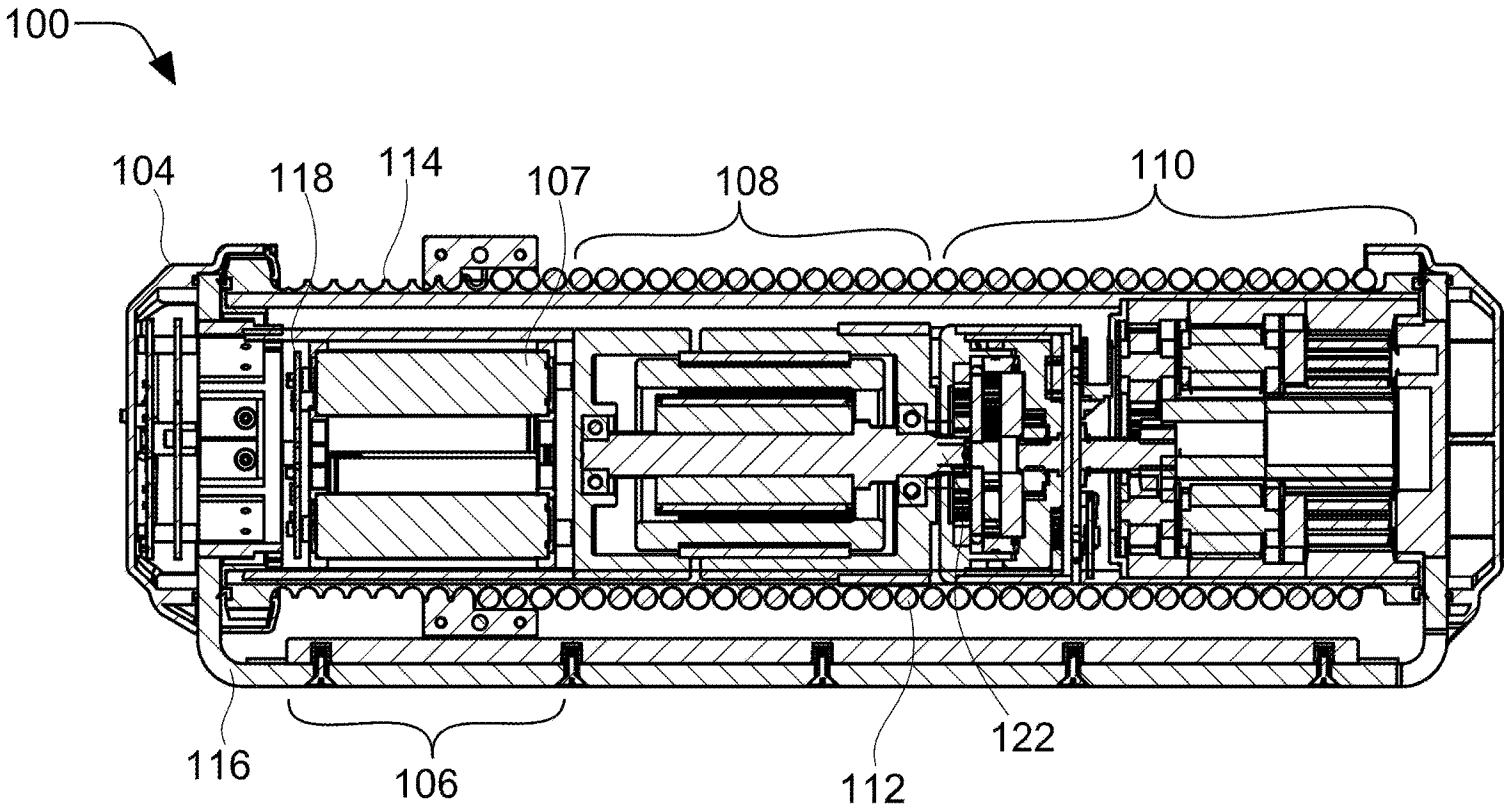
FIG. 1A shows a cross-sectional side elevation view of a winch.
Figure 1B:
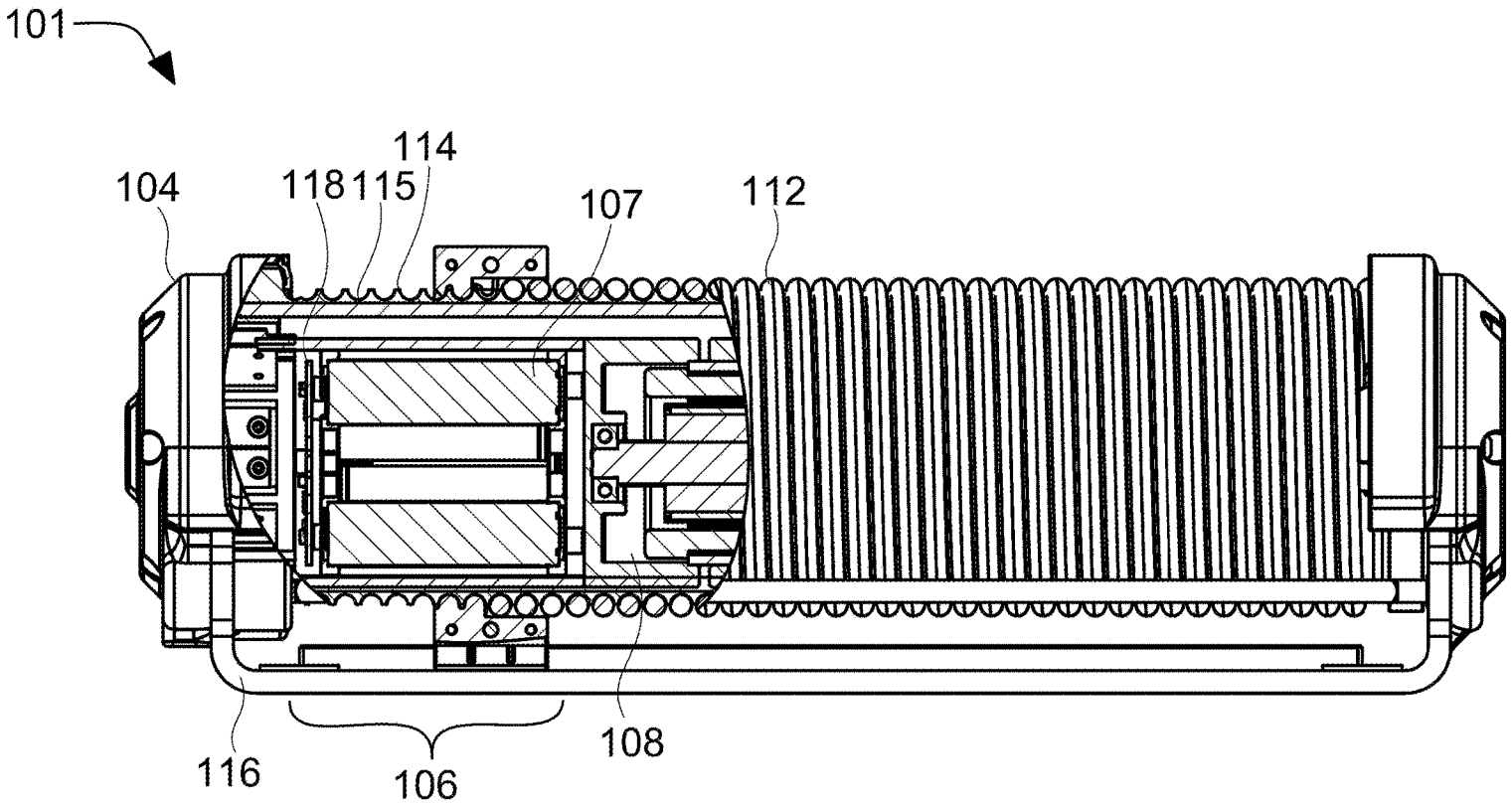
FIG. 1B shows a side elevation view of the winch of FIG. 1A, but with only a portion of the winch cross-sectioned to show the battery pack and motor.
Figure 1D:
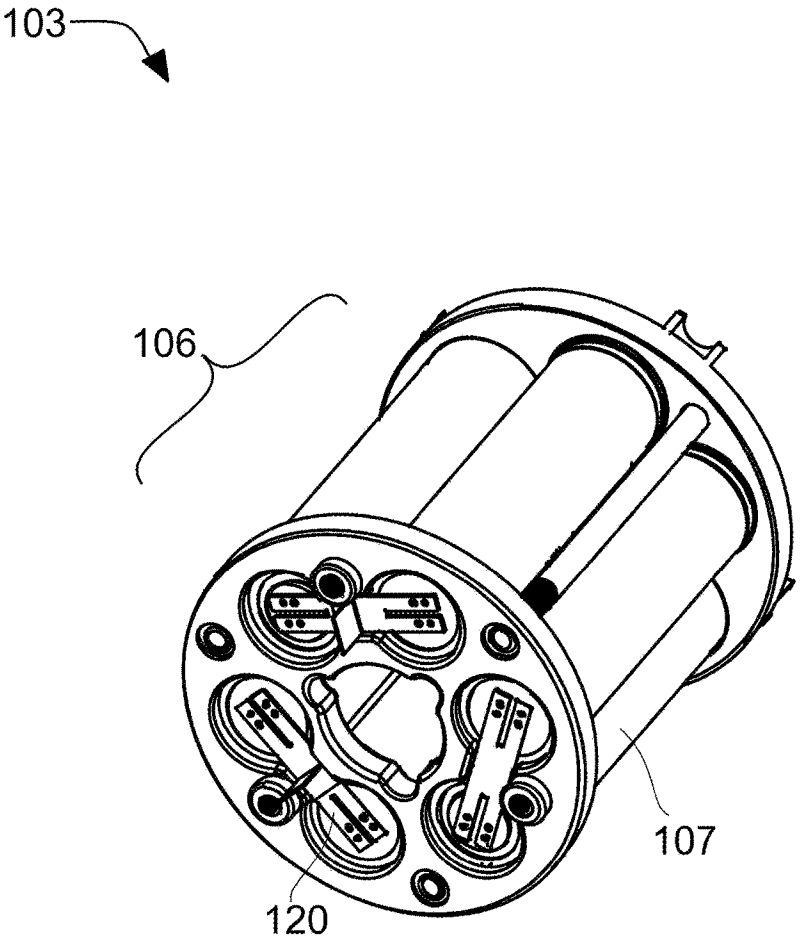
FIG. 1D shows a front-right perspective view of the battery pack of FIG. 1A without the controller.
Figure 1C:
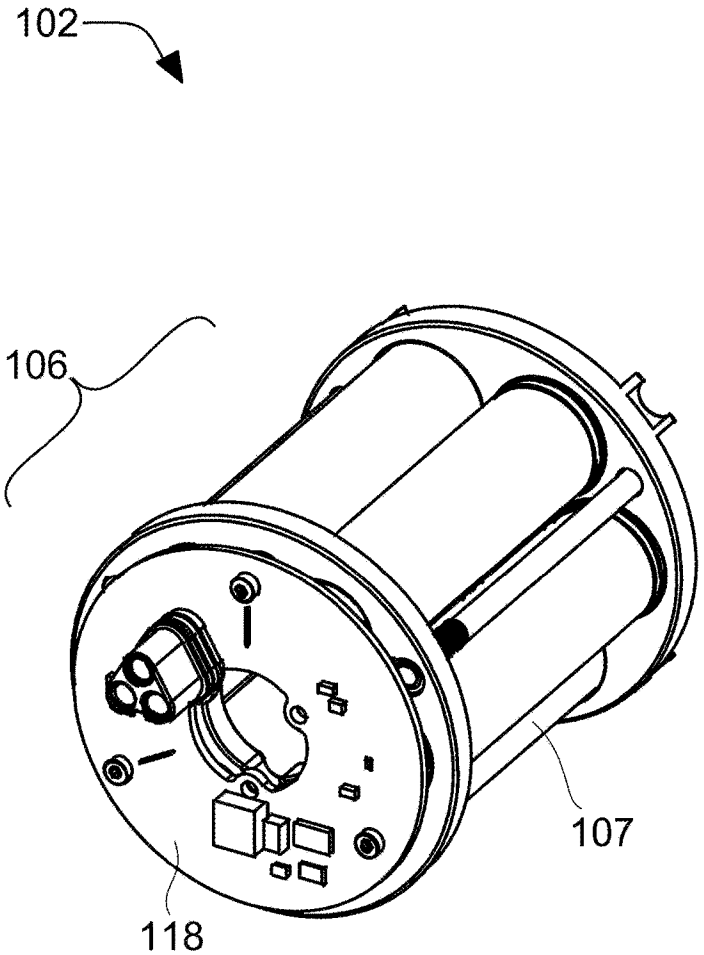
FIG. 1C shows a front-right perspective view of the battery pack of FIG. 1A with a controller.

Referring now to the Figures, FIG. 1A shows a cross-sectional side elevation view 100 of a winch that may be used in the described devices, systems, and methods. FIG. 1B shows a side elevation view 101 of the winch of FIG. 1A, but with only a portion of the winch cross-sectioned to show the battery pack and motor. FIG. 1C shows a front-right perspective view 102 of the battery pack of FIG. 1A with a controller. FIG. 1D shows a front-right perspective view 103 of the battery pack of FIG. 1A without the controller. Winch 104 includes a mounting base 116, battery pack 106, motor 108, shaft 122, gearboxes 110, and drum 114. Battery pack 106 includes six batteries 107, switches 120, and a controller 118. Battery pack 106 provides an overall voltage to motor 108. Drum 114 has grooves 115 through which winch line 112 is coiled. Motor 108 drives shaft 122, driving gearboxes 110. Gearboxes 110 drive drum 114, which pays out line 112 when rotating one direction, and reels line 112 in when rotating the opposite direction.

Figure 2A:
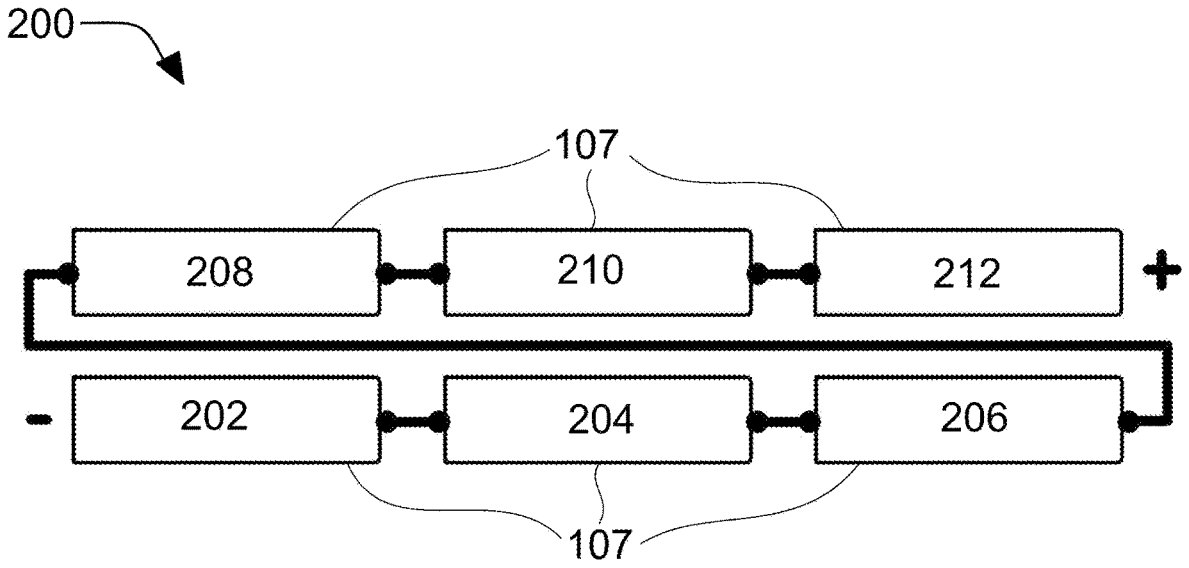
FIG. 2A shows a series arrangement of the six batteries of FIG. 1A.
Figure 2B:
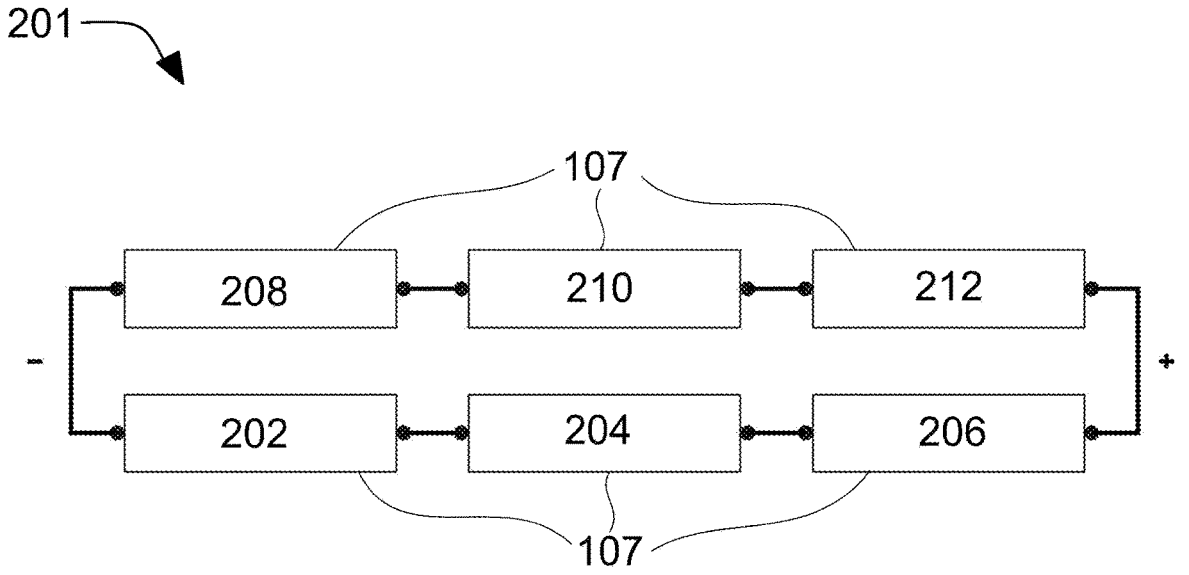
FIG. 2B shows three batteries in series, in parallel with three batteries in series, the batteries of FIG. 1A.

In the present example, battery pack 106 may have two arrangements, each the result of a discrete voltage step. These arrangements are shown in FIGS. 2A-B. The gearboxes 110 combine to provide a 5:1 ratio between low and high gear when using the parallel arrangement of batteries in FIG. 2B.

Referring to FIGS. 2A-B, FIG. 2A shows a series arrangement of the six batteries 107 of FIG. 1A at 200. FIG. 2B shows three batteries 107 in series, in parallel with three batteries 107 in series at 201. The combination may be used in the described devices, systems, and methods. The battery pack 106, when in the series configuration 200, has double the voltage of the configuration at 201, and is designed to power the motor 108 to pull low to no loads at double the line speeds. In this, batteries 107 are connected positive to negative as 202, 204, 206, 208, 210, and 212. When coupled with the gearboxes 110, this can provide a 10:1 ratio between low and high gear. The battery pack 106, when in the parallel/series configuration 201, has half the voltage of the configuration at 200, and is designed to power the motor 108 to pull high loads at half the line speeds, resulting in the 5:1 ratio between low and high gear. In other embodiments, the six batteries 107 could all be placed in parallel. In other embodiments, the six batteries 107 could be placed two in series, in parallel with two in series, in parallel with two in series.

Figure 3:
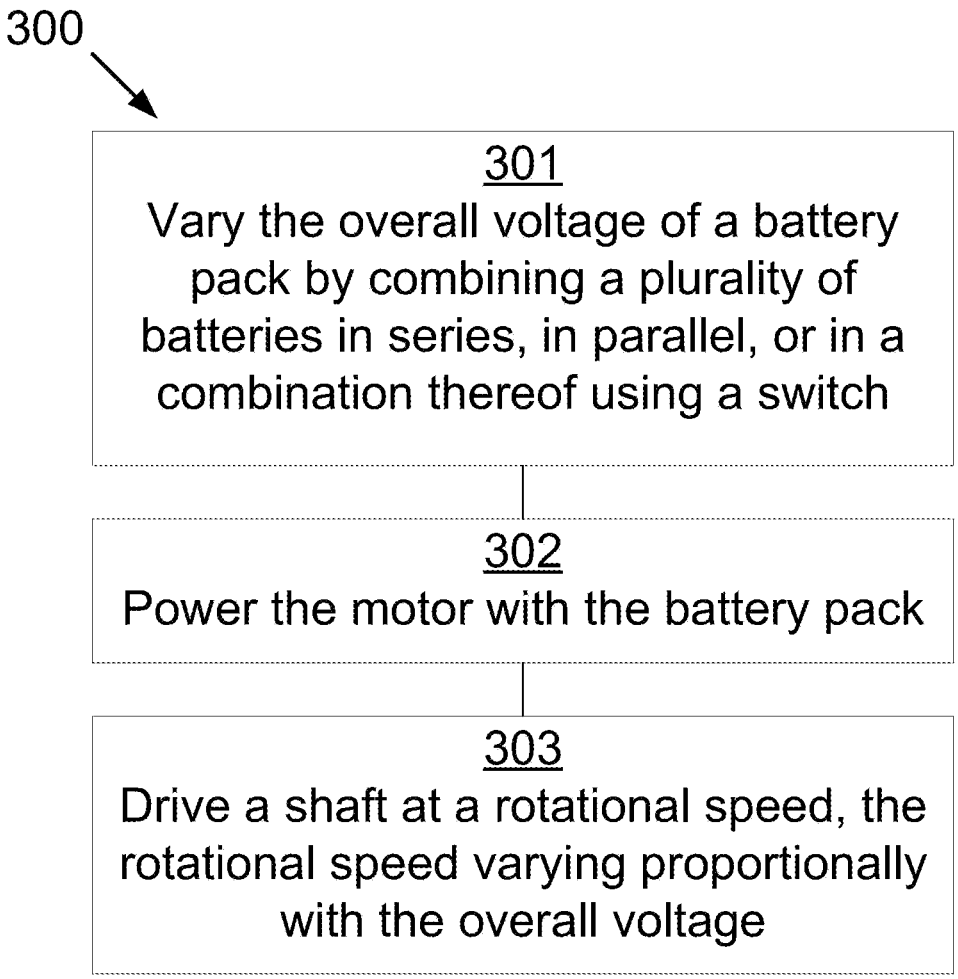
FIG. 3 shows a method for varying rotational speed.

Referring to FIG. 3, FIG. 3 shows a method for varying rotational speed at 300, that may be used in the described devices, systems, and methods. At 301, the overall voltage of a battery pack is varied in discrete steps by combining a plurality of batteries in series, in parallel, or in a combination thereof using a switch. The battery pack includes a plurality of batteries and a switch. At 302, a motor is powered with the battery pack. The motor includes a shaft. At 303, the motor drives the shaft at a rotational speed, the rotational speed varying proportionally with the overall voltage.

Figure 4:
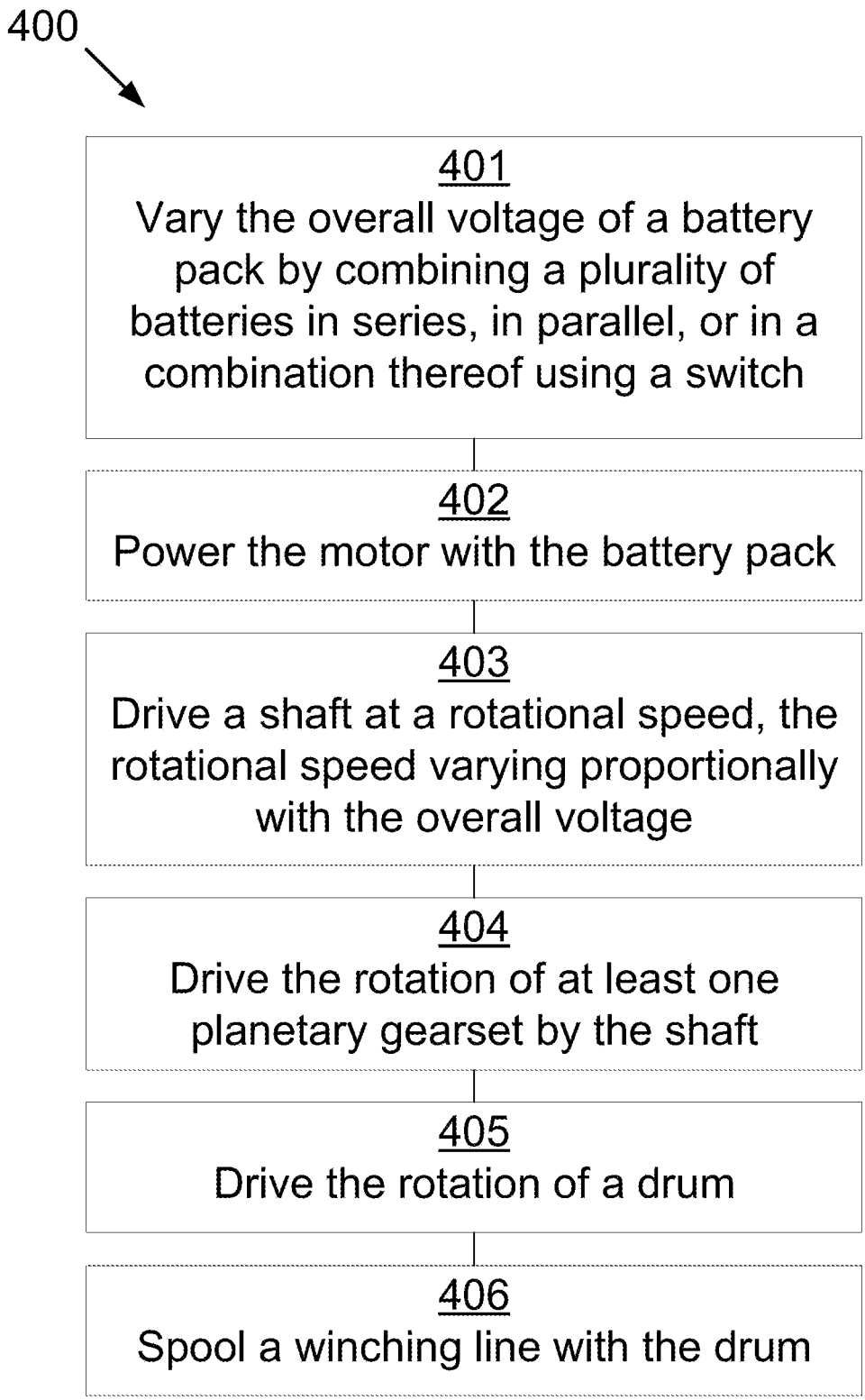
FIG. 4 shows a method for varying rotational speed.

Referring to FIG. 4, FIG. 4 shows a method for varying rotational speed at 400, that may be used in the described devices, systems, and methods. At 401, the overall voltage of a battery pack is varied in discrete steps by combining a plurality of batteries in series, in parallel, or in a combination thereof using a switch. The battery pack includes a plurality of batteries and a switch. At 402, a motor is powered with the battery pack. The motor includes a shaft. At 403, the motor drives the shaft at a rotational speed, the rotational speed varying proportionally with the overall voltage. At 404, the shaft drives the rotation of at least one planetary gearset. At 405, the at least one planetary gearset drives the rotation of a drum. At 406, the drum spools a winching line.

In some embodiments, a controller controls the switch. The battery pack may include a voltmeter, an amp meter, or a combination thereof, which may send signals to the controller regarding the voltage and current of the battery pack.

In some embodiments, the switch may include a bipolar transistor, a power diode, a MOSFET, an IGBT, an SCR, a TRIAC, a GTO, a relay, or a combination thereof.

In some embodiments, the plurality of batteries may be rechargeable batteries.

The invention claimed is:

1. A device comprising:

a battery pack comprising a plurality of batteries and a switch, the battery pack having an overall voltage;

the switch varies the overall voltage in discrete steps by changing the arrangement of the plurality of batteries, whether in series, in parallel, or in a combination thereof;

a motor comprising a shaft, wherein the battery pack powers the motor which drives the shaft at a rotational speed, and wherein the rotational speed varies proportionally with the overall voltage.

2. The device of claim 1, further comprising at least one planetary gearset, wherein the shaft drives rotation of the at least one planetary gearset.

3. The device of claim 2, further comprising a drum, wherein the at least one planetary gearsets drive rotation of the drum.

4. The device of claim 3, wherein the drum is a spool for a winching line.

5. The device of claim 4, wherein the drum rotates at a first rotational speed while the winching line is under a load due to a first overall voltage, and the drum rotates at a second rotational speed while the winching line is under substantially no load due to a second overall voltage, wherein the second rotational speed is greater than the first rotational speed.

6. The device of claim 1, further comprising a controller which controls the switch.

7. The device of claim 6, wherein the battery pack further comprises a voltmeter, an amp meter, or a combination thereof.

8. The device of claim 7, wherein the voltmeter, the amp meter, or a combination thereof, send signals to the controller regarding the voltage and current of the battery pack.

9. The device of claim 1, wherein the switch comprises a bipolar transistor, a power diode, a MOSFET, an IGBT, an SCR, a TRIAC, a GTO, a relay, or a combination thereof.

10. The device of claim 1, wherein the plurality of batteries comprise rechargeable batteries.

11. A method for varying rotational speed comprising:

varying an overall voltage of a battery pack in discrete steps by changing the arrangement of a plurality of batteries, whether in series, in parallel, or in a combination thereof using a switch, the battery pack comprising the plurality of batteries and the switch; and powering a motor with the battery pack, the motor comprising a shaft, the motor driving the shaft at a rotational speed, wherein the rotational speed varies proportionally with the overall voltage.

12. The device of claim 11, further comprising driving the rotation of at least one planetary gearset with the shaft.

13. The method of claim 12, further comprising driving the rotation of a drum with the at least one planetary gearset.

14. The method of claim 13, further comprising spooling a winching line on the drum.

15. The method of claim 14, wherein driving the rotation of the drum at a first overall voltage produces a first rotational speed of the drum while the winching line is under a load and driving the rotation of the drum at a second overall voltage produces a second rotational speed of the drum while the winching line is under substantially no load, wherein the second rotational speed is greater than the first rotational speed.

16. The method of claim 11, further comprising controlling the switch with a controller.

17. The method of claim 16, wherein the battery pack further comprises a voltmeter, an amp meter, or a combination thereof.

18. The method of claim 17, further comprising sending signals from the voltmeter, the amp meter, or the combination thereof, to the controller regarding the voltage and current of the battery pack.

19. The method of claim 11, wherein the switch comprises a bipolar transistor, a power diode, a MOSFET, an IGBT, an SCR, a TRIAC, a GTO, a relay, or a combination thereof.

20. The method of claim 11, wherein the plurality of batteries comprise rechargeable batteries.

* * * * *